US007883662B2

(12) United States Patent
LaVoie et al.

(10) Patent No.: US 7,883,662 B2
(45) Date of Patent: Feb. 8, 2011

(54) METAL INJECTION MOLDING METHODS AND FEEDSTOCKS

(75) Inventors: Larry E. LaVoie, Klamath Falls, OR (US); James C. Moore, Portland, OR (US); David L. Walker, Camas, WA (US)

(73) Assignee: Viper Technologies, Portland, OR (US)

( * ) Notice: Subject to any disclaimer, the term of this patent is extended or adjusted under 35 U.S.C. 154(b) by 618 days.

(21) Appl. No.: 11/941,018

(22) Filed: Nov. 15, 2007

(65) Prior Publication Data

US 2009/0129961 A1 May 21, 2009

(51) Int. Cl.
*B22F 3/16* (2006.01)
*C22C 1/05* (2006.01)

(52) U.S. Cl. ..... 419/39; 419/36

(58) Field of Classification Search ..... 75/228, 75/245, 252, 255; 264/125, 645, 669, 670; 419/26, 29, 36, 39, 65
See application file for complete search history.

(56) References Cited

U.S. PATENT DOCUMENTS

| | | | | |
|---|---|---|---|---|
| 2,478,420 | A | 8/1949 | Payson | 420/105 |
| 3,155,502 | A | 11/1964 | Brown | 75/214 |
| 3,302,073 | A | 1/1967 | Broodo | 317/230 |
| 3,325,277 | A | 6/1967 | Huseby | 419/29 |
| 3,330,892 | A | 7/1967 | Herrmann | 264/63 |
| 3,725,142 | A | 4/1973 | Huseby | 419/12 |
| 3,769,044 | A | 10/1973 | Horton | 106/38.3 |
| 3,802,939 | A | 4/1974 | Ohtani et al. | 428/636 |
| 3,841,848 | A | 10/1974 | Kasai et al. | 428/564 |
| 3,864,809 | A | 2/1975 | Donachie | 419/28 |
| 4,049,429 | A | 9/1977 | Donachie | 75/246 |
| 4,284,121 | A | 8/1981 | Horton | 164/520 |
| 4,448,746 | A | 5/1984 | Kubo et al. | 148/500 |
| 4,457,851 | A | 7/1984 | Tabaru et al. | 252/2.63 |
| 4,478,790 | A | 10/1984 | Hüther et al. | 419/54 |
| 4,606,767 | A | 8/1986 | Nagato | 75/242 |
| 4,721,599 | A | 1/1988 | Nakamura | 419/23 |

(Continued)

FOREIGN PATENT DOCUMENTS

| | | |
|---|---|---|
| JP | 60-216512 | 10/1985 |

(Continued)

OTHER PUBLICATIONS

Johnson, John L., "Mass Production of Medical Devices by Metal Injection Molding", *Medical Device & Diagnostics Industry*, Nov. 2002, 5 pages.

(Continued)

*Primary Examiner*—George Wyszomierski
*Assistant Examiner*—Mark L Shevin
(74) *Attorney, Agent, or Firm*—Mohr IP Law Solutions, P.C.

(57) ABSTRACT

Metal injection molding methods and feedstocks. Metal injection molding methods include forming a feedstock, molding the feedstock into a molded article, substantially removing a lubricant, a thermoplastic, and an aromatic binder from the molded article, and sintering the molded article into a metal article. In some examples, metal injection molding methods include oxygen reduction methods. In some examples, metal injection molding methods include densification methods. Metal injection molding feedstocks include a lubricant, a thermoplastic, and aromatic binder, and a metal powder.

22 Claims, 10 Drawing Sheets

U.S. PATENT DOCUMENTS

| | | | | |
|---|---|---|---|---|
| 4,765,950 | A | 8/1988 | Johnson | 419/2 |
| 4,894,088 | A | 1/1990 | Yamaguchi et al. | 75/232 |
| 4,964,907 | A | 10/1990 | Kiyota et al. | 75/235 |
| 5,022,935 | A * | 6/1991 | Fisher | 148/513 |
| 5,159,007 | A | 10/1992 | Saitoh et al. | 524/439 |
| 5,194,203 | A * | 3/1993 | Kankawa et al. | 264/125 |
| 5,211,775 | A | 5/1993 | Fisher et al. | 148/421 |
| 5,308,576 | A | 5/1994 | Green et al. | 419/38 |
| 5,338,508 | A | 8/1994 | Nitta et al. | 420/120 |
| 5,403,374 | A | 4/1995 | Kitagawa et al. | 75/238 |
| 5,403,411 | A | 4/1995 | Smith et al. | 148/514 |
| 5,441,695 | A | 8/1995 | Gladden | 419/37 |
| 5,464,670 | A | 11/1995 | Ikuma et al. | 428/35.8 |
| 5,545,248 | A | 8/1996 | Tokumoto et al. | 75/238 |
| 5,665,289 | A * | 9/1997 | Chung et al. | 264/628 |
| 5,733,580 | A | 3/1998 | Ikuma et al. | 425/3 |
| 5,738,817 | A | 4/1998 | Danforth et al. | 264/603 |
| 5,782,954 | A | 7/1998 | Luk | 419/19 |
| 5,848,350 | A | 12/1998 | Bulger | 419/36 |
| 5,854,379 | A | 12/1998 | Takayama et al. | 528/338 |
| 6,027,686 | A | 2/2000 | Takahashi et al. | 419/38 |
| 6,075,083 | A | 6/2000 | Peiris | 524/439 |
| 6,306,196 | B1 | 10/2001 | Date et al. | 75/245 |
| 6,376,585 | B1 | 4/2002 | Schofalvi et al. | 524/195 |
| 6,555,051 | B1 | 4/2003 | Sakata et al. | 419/41 |
| 6,689,311 | B2 | 2/2004 | Morita et al. | 419/8 |
| 6,725,901 | B1 | 4/2004 | Kramer et al. | 164/113 |
| 6,759,004 | B1 | 7/2004 | Dwivedi | 419/2 |
| 6,770,114 | B2 | 8/2004 | Bartone et al. | 75/255 |
| 6,846,862 | B2 | 1/2005 | Schofalvi et al. | 524/195 |
| 6,849,229 | B2 | 2/2005 | Ott et al. | 419/36 |
| 6,939,488 | B2 | 9/2005 | Blömacher et al. | 264/5 |
| 7,063,815 | B2 | 6/2006 | Li et al. | 419/46 |
| 7,285,241 | B2 | 10/2007 | Puide | 264/625 |
| 2005/0196312 | A1 * | 9/2005 | Nyberg et al. | 419/36 |
| 2006/0018780 | A1 | 1/2006 | Hosamani et al. | 419/24 |
| 2006/0285991 | A1 | 12/2006 | McKinley | 419/36 |
| 2007/0065329 | A1 | 3/2007 | Nyberg et al. | 419/60 |
| 2007/0068340 | A1 | 3/2007 | Nyberg et al. | 75/252 |

FOREIGN PATENT DOCUMENTS

| | | |
|---|---|---|
| JP | 04-116104 | 4/1992 |
| JP | 06-002011 | 1/1994 |
| JP | 07-090318 | 4/1995 |
| JP | 09-013153 | 1/1997 |
| JP | 09-148166 | 6/1997 |

OTHER PUBLICATIONS

Nyberg, Eric, "New Titanium MIM Process", *Expanded Stories From PM Newsbytes*, Sep. 11, 2006, 1 page.

Weil et al., K. Scott, "A New Binder for Powder Injection Molding Titanium and Other Reactive Metals", *Journal of Materials Processing Technology*, vol. 176, Issues 1-3, Jun. 6, 2006, p. 205-209.

Weil et al., K. Scott, "Manufacturers 'Need Better Quality Titanium PM Powders'", *Metal Powder Report*, vol. 60, Issue 10, Oct. 2005, p. 8-13.

* cited by examiner

METAL INJECTION MOLDING METHODS AND FEEDSTOCKS

BACKGROUND

Metal injection molding provides a technique for forming net-shape and near net-shape metal articles. Alternative techniques for forming metal articles include molten metal casting, solid metal machining, and metal powder pressing. Typically, the alternative techniques require extended processing to impart fine details or to form complex shapes. Further, deburring and polishing are often required with the alternative methods.

Metal injection molding feedstocks typically include components to assist a molded article retain its shape and withstand the processing required to form the final metal article. Often times, metal injection molding feedstocks include binders. Wax, polymer, and aqueous binders have been used. Lubricants, sintering aids, such as silver, and other additives are employed in known feedstock mixtures. A variety of metals and metal alloys, including copper, stainless steel, titanium, tantalum, and cobalt have been used for different applications.

Metal articles formed via metal injection molding can be used in a variety of industries including the medical, aerospace, and consumer goods industries. Metal articles can be used for surgical implements and surgical implants, among other uses. Certain industries, such as the medical and aerospace industries, have stringent requirements for the properties of metal articles. For example, enhanced ductility, density, and purity are often required to meet product specifications and standards, such as applicable American Society for Testing and Materials (ASTM) International standards.

Examples of metal injection molding methods and feedstocks and other metal processing techniques are disclosed in the following US patent and patent application references, which are hereby incorporated by reference for all purposes: U.S. Pat. Nos. 5,159,007; 5,211,775; 5,308,576; 5,848,350; 6,725,901; 2005/0196312; 2006/0285991; 2007/0065329; and 2007/0068340.

Further examples of metal injection molding methods and feedstocks are disclosed in the following non-patent references, which are hereby incorporated by reference:

"A New Binder for Powder Injection Molding Titanium and Other Reactive Metals," Weil et al., Journal of Materials Processing Technology, Vol. 176, pages 205-209, 2006; "Manufacturers 'need better quality titanium PM powders,'" Metal Powder Report, Vol. 60, Issue 10, pages 8-13, October 2005; and "Mass Production of Medical Devices by Metal Injection Molding," John L. Johnson, Medical Device & Diagnostic Industry, November 2002.

SUMMARY

The present disclosure is directed to metal injection molding methods and feedstocks. Metal injection molding methods include forming a feedstock, molding the feedstock into a molded article, substantially removing a lubricant, a thermoplastic, and an aromatic binder from the molded article, and sintering the molded article into a metal article. In some examples, metal injection molding methods include oxygen reduction methods. In some examples, metal injection molding methods include densification methods. Metal injection molding feedstocks include a lubricant, a thermoplastic, and aromatic binder, and a metal powder.

DETAILED DESCRIPTION

Metal injection molding methods 10 and feedstocks 90 according to the present disclosure will become better understood through review of the following detailed description in conjunction with the drawings and the claims. The detailed description and drawings merely provide examples of the inventions recited in the claims. Those skilled in the art will understand that the disclosed examples may be varied, modified, and altered for different optimization and design considerations without departing from the scope and spirit of the inventions recited in the claims.

Figure 1:
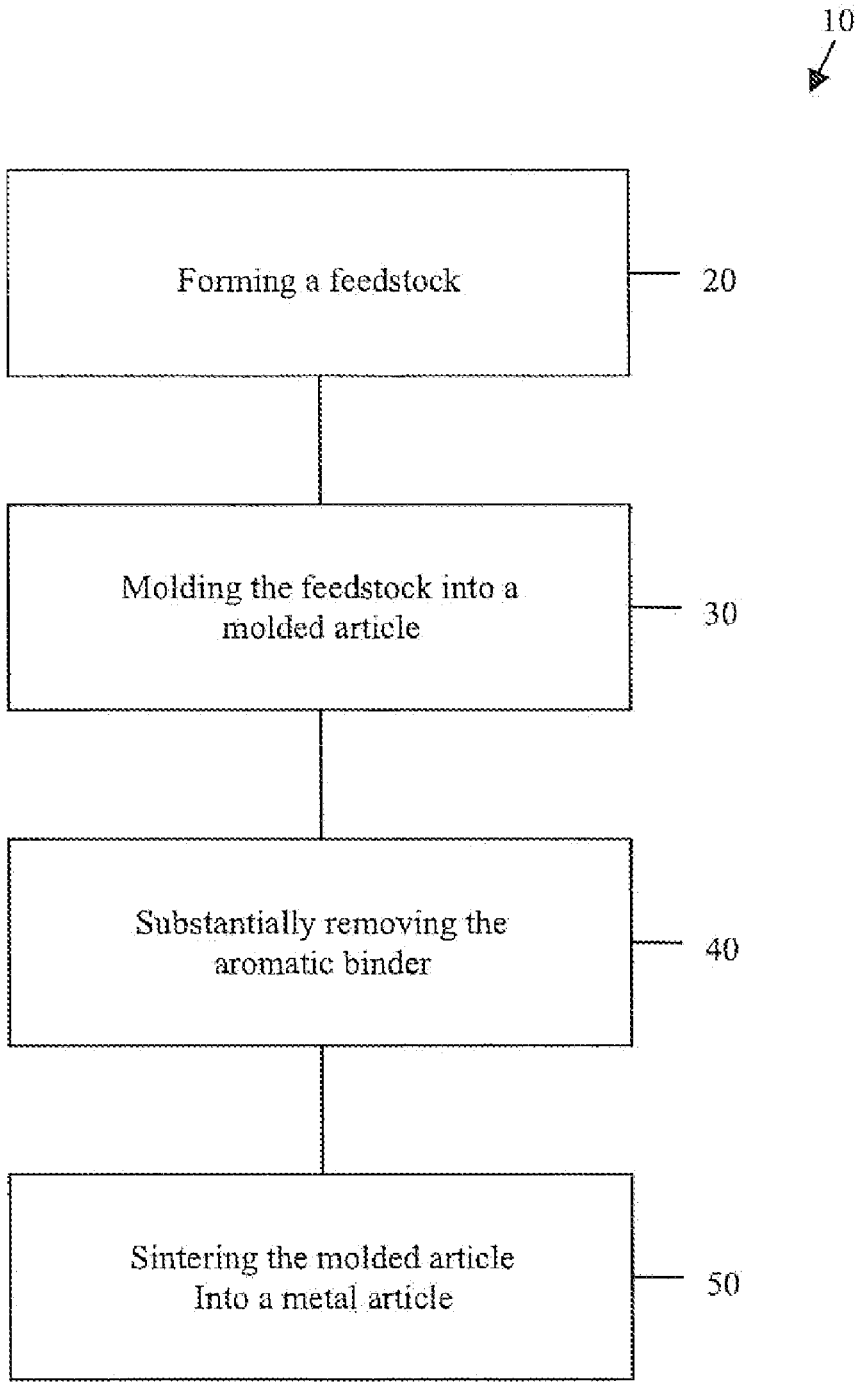
FIG. 1 schematically depicts a metal injection molding method according to the present disclosure.

As shown in FIG. 1, a metal injection molding method 10 may include forming a feedstock 20, molding the feedstock into a molded article 30, substantially removing an aromatic binder 40, and sintering the molded article into a metal article 50. Method 10 can be carried out from a lab scale to a mass production scale. Any suitable production equipment may be used, including vessels, containers, impellers, mixers, granulators, injection molding machines, vacuum furnaces, vacuum ovens, and dryers. Forming a feedstock 20 may be conducted under a cover of inert gas, such as argon. However, an inert gas cover is not necessary, and the feedstock may be formed in an atmosphere of air.

Figure 2:
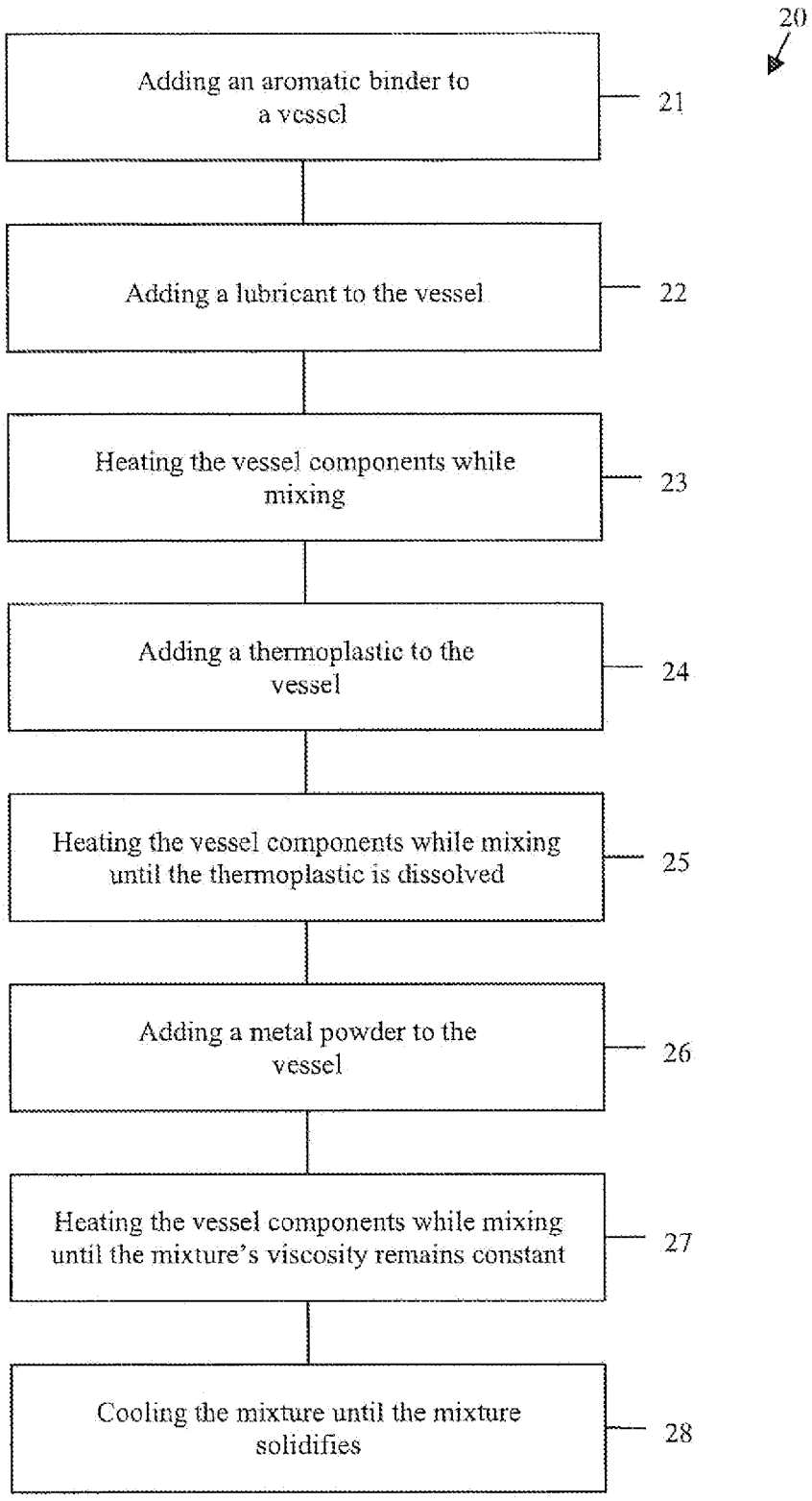
FIG. 2 schematically depicts an example of forming a feedstock according to the method of FIG. 1.
Figure 8:
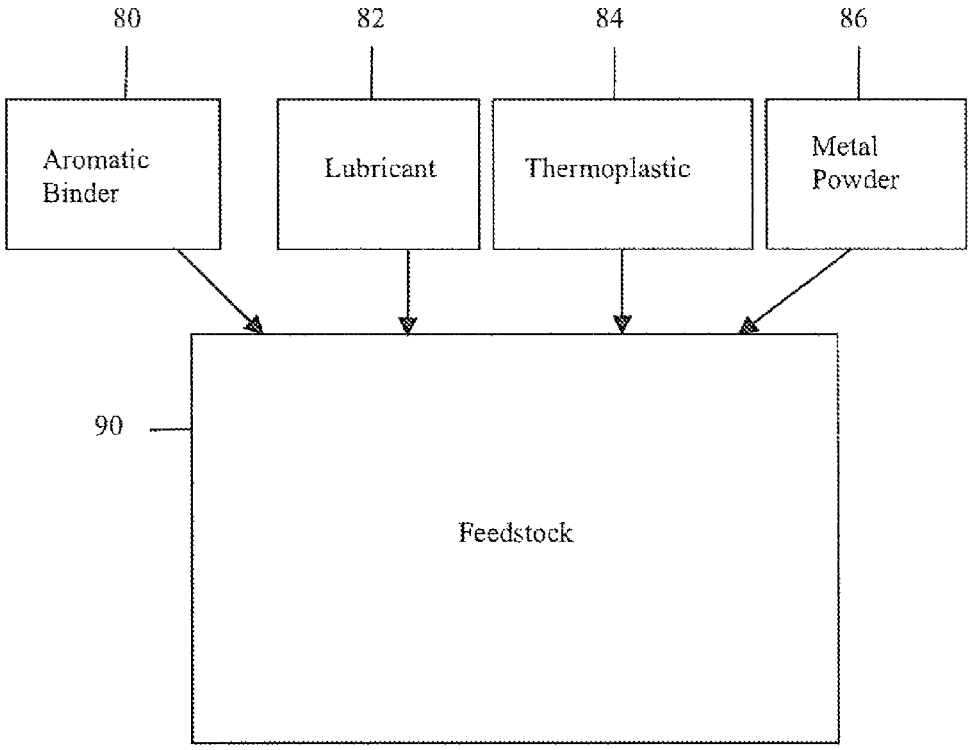
FIG. 8 schematically depicts a feedstock according to the present disclosure.

Forming a feedstock 20 produces a mixture that imparts desired properties into the final metal article and that allows the molded article to retain its shape during processing. As shown in FIGS. 2 and 8, forming the feedstock 20 may include adding an aromatic binder 80 to a vessel 21. In some examples, the vessel is sealable to prevent evaporation of components, includes a variable speed mixing blade with a sealed shaft, and can be heated to specified temperatures. A suitable amount of aromatic binder 80 includes 20-40% aromatic binder (all percentages are by volume of the feedstock, unless indicated otherwise). More preferably, 28-32% aromatic binder may be added to the vessel.

Aromatic binder 80 can be any of a number of aromatic compounds. Aromatic binders 80 having relatively low melting and/or sublimation temperatures may be particularly suitable. For example, naphthalene melts at 176° F. and sublimates at room temperature. Aromatic binder 80 ideally helps retain the shape of the molded article and is removable via relatively low temperature means.

As further shown in FIGS. 2 and 8, forming a feedstock 20 may include adding a lubricant 82 to the vessel 22. Lubricant 82 typically aids in the removal of molded articles from the mold as well as improving the flow characteristics of feedstock 90. Lubricant 82 may include organic, fatty acids, such as stearic acid. Additionally or alternatively, lubricant 82 may include solid waxes, such as microcrystalline waxes. A suitable lubricant addition range includes 0-10% lubricant, preferably 0-6% lubricant, and more preferably 3-6% lubricant.

The vessel components are typically heated and mixed 23, such as by stirring, to form a uniform liquid as provided in FIG. 2. The vessel may be heated to a temperature above the melting point of the aromatic binder. When naphthalene is used as the aromatic binder, the vessel is heated to approximately 200° F. As shown in FIGS. 2 and 8, adding a thermoplastic 84 to the vessel 24 may occur while the vessel is typically being heated and mixed. Thermoplastic 84 may be a solid at room temperature, such as in the form of solid beads. Following and during addition of the thermoplastic 24, the vessel may be heated and mixed until thermoplastic 84 is dissolved 25. In examples where thermoplastic 84 is polystyrene, dissolution can occur in approximately 10 minutes.

A variety of thermoplastics may be used in method 10 and feedstock 90 to strengthen the molded article. Polystyrene is one example of a suitable thermoplastic. Thermoplastic 84 may additionally or alternatively include ethylene vinyl acetate, polyethylene, and butadiene. Suitable thermoplastic addition ranges include 5-15% thermoplastic, and preferably 8-12% thermoplastic.

With further reference to FIGS. 2 and 8, forming the feedstock 20 includes adding a metal powder 86 to the vessel 26. Metal powder 86 may constitute the remaining volume of the mixture. Thus, metal powder 86 may represent 35-74%, and preferably 44-69% of feedstock 90. Typically, adding metal powder 86 to the vessel 26 occurs while mixing the contents of the vessel and maintaining the mixture temperature at approximately 200° F.

Metal power 86 defines many of the properties of the final metal article. A variety of metal powders may be used, such as powders of copper, stainless steel, titanium, tantalum, and cobalt, as well as alloys and combinations thereof. Titanium has been found particularly suitable for certain applications. Pure titanium, titanium alloys, such as titanium and a blend of elements, titanium hydride, and titanium matrix composites may be used. Metal powder 86 may have a spherical shape, an angular shape, and combinations thereof. The size of metal powder 86 typically ranges between 30 to 75 microns.

After addition of the metal powder 26, forming a feedstock 20 typically includes continuing to heat the vessel contents while mixing until the viscosity of the mixture remains constant 27. In some examples, the viscosity remains constant after 20 to 30 minutes of mixing and heating. Once the viscosity becomes constant, a uniform liquid is formed, which represents feedstock 90.

As shown in FIG. 2, forming a feedstock 20 may optionally include the step of cooling feedstock 90 until it solidifies 28. Feedstock 90 may be granulated into a powder by continuing to stir feedstock 90 as it is cooled. Alternatively, feedstock 90 may be discharged onto a metal sheet and allowed to cool. After solidifying on the metal sheet, feedstock 90 is typically ground into a powder. In some examples, feedstock 90 is stored in a sealed container after granulation.

Figure 3:
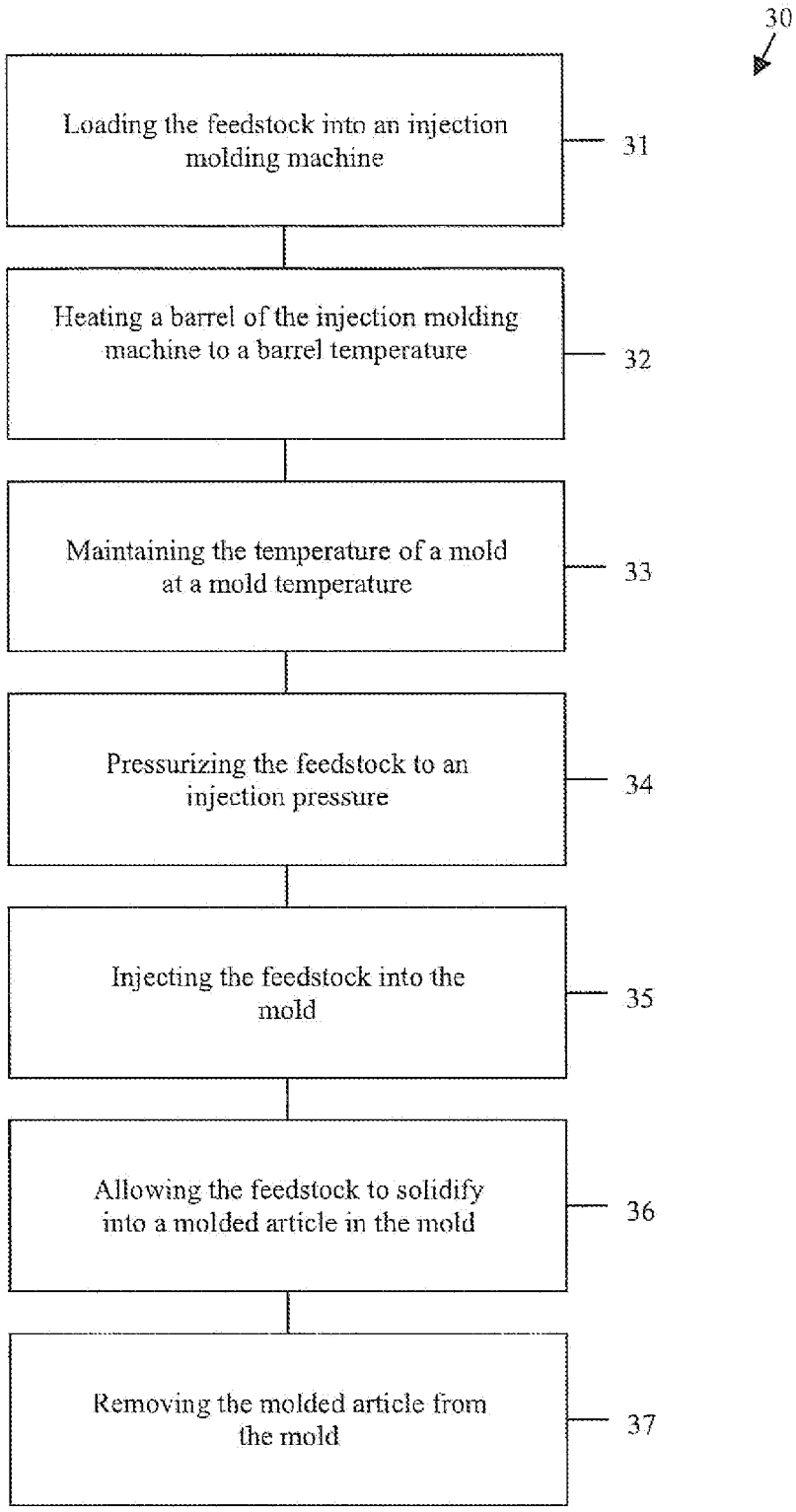
FIG. 3 schematically depicts an example of molding the feedstock into a molded article according to the method of FIG. 1.

Method 10 includes the step of molding feedstock 90 into a molded article 30 to give feedstock 90, and eventually the metal article, a desired shape. As shown in FIG. 3, molding the feedstock 30 may include loading feedstock 90 into an injection molding machine 31. Any type of injection molding machine compatible with the composition and properties of feedstock 90 may be used. Many standard plastic injection molding machines are suitable. Injection molding machines including a barrel and a die cavity (mold) are well known in the art.

Molding feedstock 90 into a molded article 30 may include heating the barrel of the injection molding machine to a barrel temperature 32 to heat feedstock 90 within the barrel. Barrel temperatures slightly higher than the melting point of the aromatic binder are preferred. Higher barrel temperatures can undesirably cause the composition of feedstock 90 to change. Among other undesirable consequences, a changed feedstock composition precludes the option of remolding imperfect molded articles. Typically, barrel temperatures of not more than 200° F. are used to inhibit gas bubble formation, which can cause structural defects within the molded article.

As further shown in FIG. 3, molding the feedstock 30 may include maintaining the temperature of a mold at a mold temperature 33 to cause feedstock to solidify into the molded article. For example, the mold may be maintained at a mold temperature of not more than 120° F., preferably at a temperature of not more than 90° F., and more preferably at a temperature of between 50 to 90° F. Typically, a mold temperature of 70° F. is targeted.

Feedstock 90 may be pressurized to an injection pressure 34 to inject feedstock 90 into the mold 35. Pressures of 100 to 1,000 psi are suitable for the injection pressure. In some examples, injection pressures of approximately 400-500 psi are used. Injection pressures higher than 1000 psi can damage the mold and result in improperly molded articles. It is known in the art to use injection pressures exceeding 3,000 psi, and even as high as 20,000 psi, presumably to inhibit gas bubble formation within the molded article from high barrel temperatures, such as for barrel temperatures exceeding 200° F. However, high injection pressures to inhibit gas bubble formation are not necessary when a barrel temperature of not more than 200° F. is selected for feedstocks according to the present disclosure.

As shown in FIG. 3, once feedstock 90 is injected into the mold 35, it is allowed to solidify in the mold into a molded article 36. Solidification times can range between 1 second and 1 minute, depending on the size of the molded article. Longer solidification times beyond a minute can occur when higher mold temperatures are used. After the molded article has solidified, it is removed from the mold 37. At this point, the molded article has substantially the same shape as the final metal article will have, but has a different composition and different properties.

Figure 5:
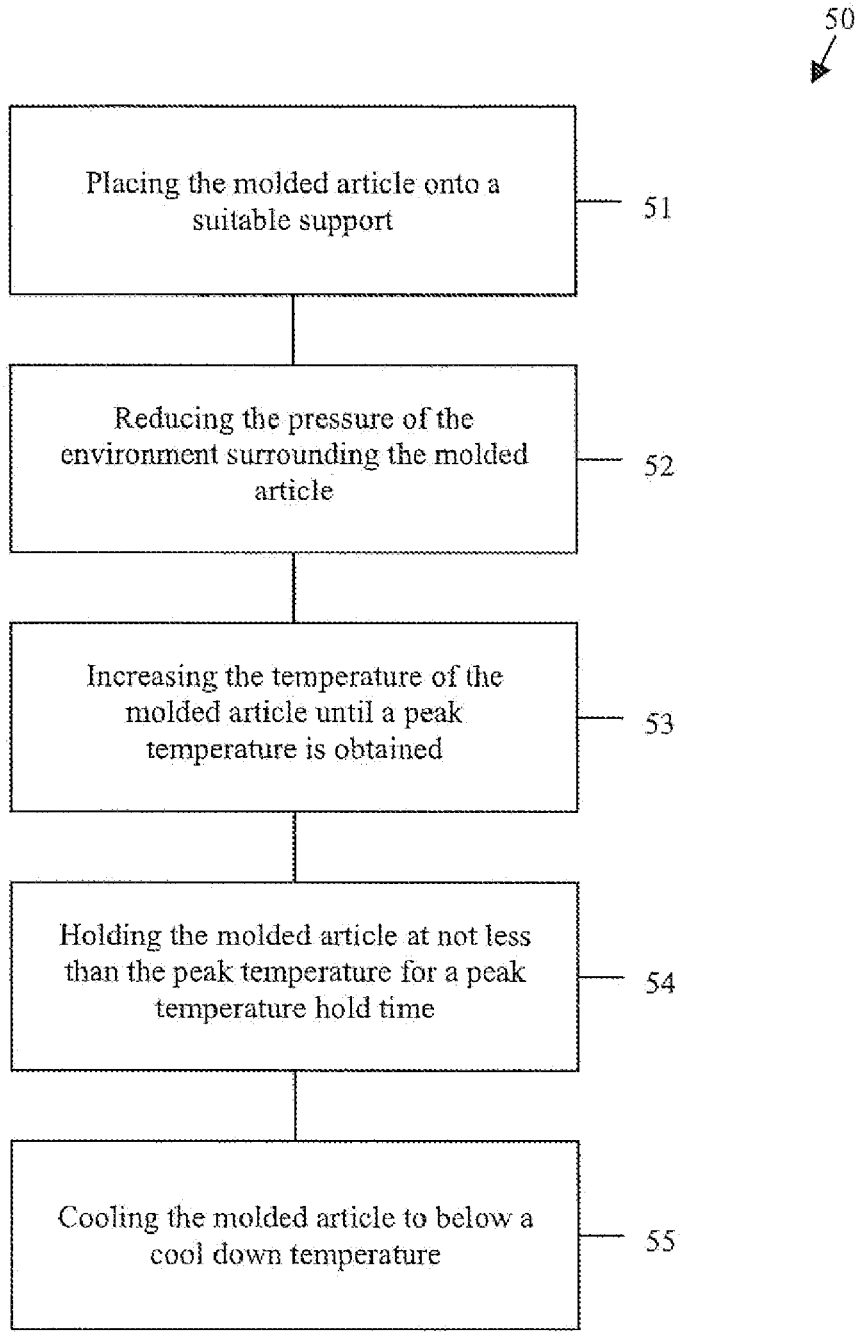
FIG. 5 schematically depicts an example of sintering the molded article into the metal article according to the method of FIG. 1.
Figure 6:
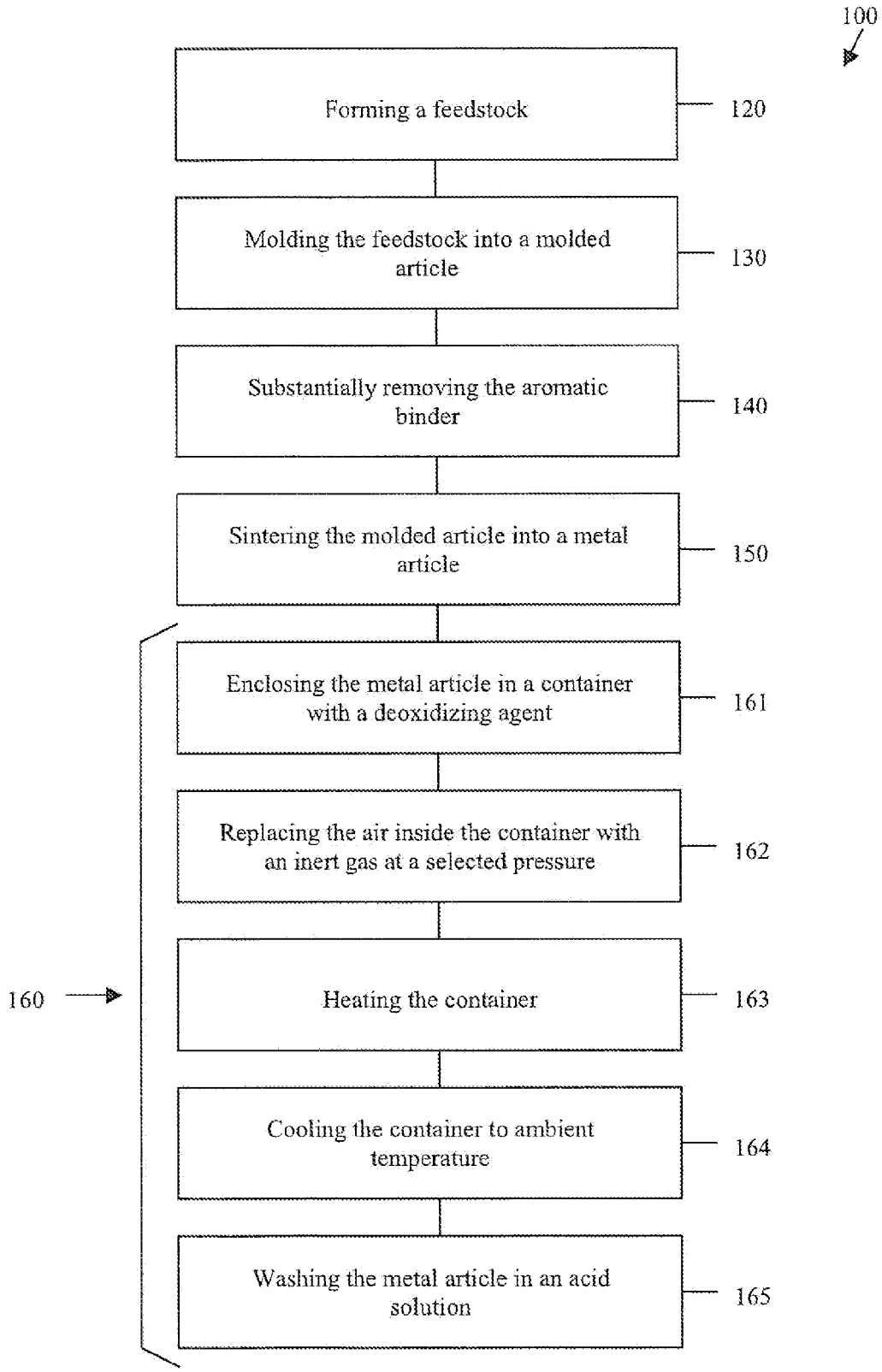
FIG. 6 schematically depicts an example of a metal injection molding and oxygen reduction method according to the present disclosure.

Once the molded article is formed, method 10 typically includes the step of substantially removing the aromatic binder 40. As shown in FIGS. 4-6, a variety of methods 40A, 40B, and 40C for substantially removing the aromatic binder are contemplated.

Figure 4A:
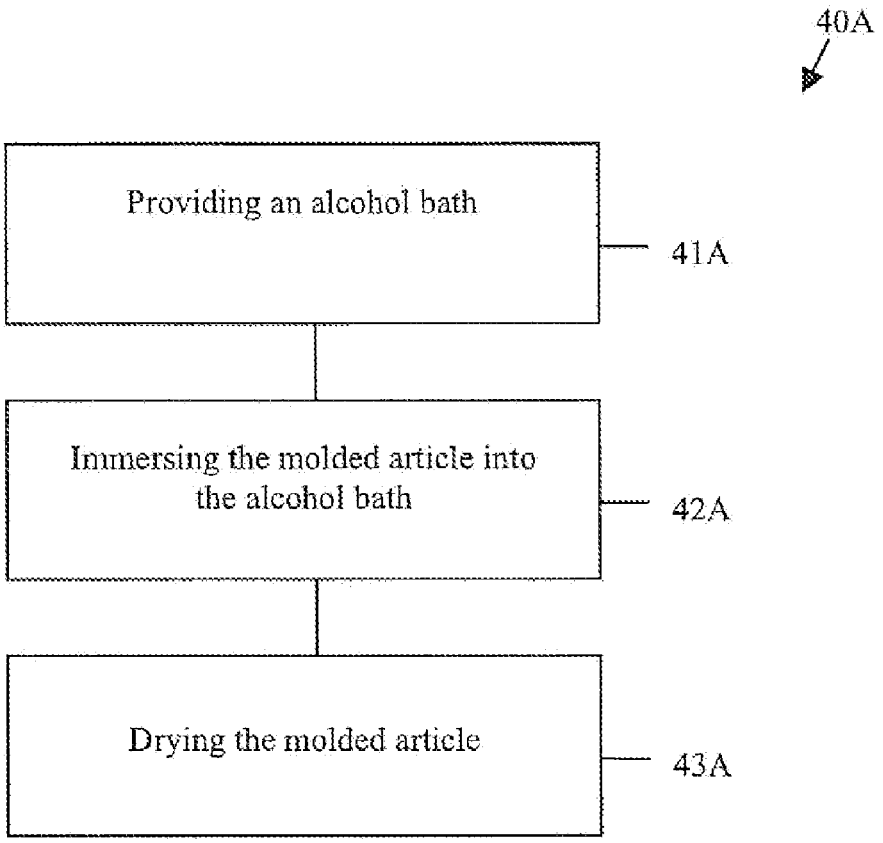
FIG. 4A schematically depicts an example of the metal injection molding method of FIG. 1 with an alcohol immersion step for substantially removing the aromatic binder.

With reference to FIG. 4A, substantially removing the aromatic binder 40A may include providing an alcohol bath 41A, such as an ethanol bath. In some examples, the alcohol bath is kept at ambient temperature. Typically, the alcohol bath is continuously distilled and replaced to reduce costs and to facilitate keeping the alcohol below the saturation point of the aromatic binder. The molded article is then immersed in the alcohol bath 42A to dissolve the aromatic binder. Often times, other components, such as the lubricant, will dissolve into the alcohol bath as well. The molded article is kept in the alcohol bath until a desired amount of aromatic binder and other components have been removed, which may take between 4 and 24 hours depending on the size of the molded article.

After the desired amount of aromatic binder and other components have been removed, the molded article is removed from the alcohol bath and dried 43A. Drying 43A may be conducted by heating the molded article to a temperature below the melting point of the thermoplastic remaining in the molded article, such as a temperature between ambient and 150° F. Drying may be conducted in an oven under vacuum or with moving air. The molded article may be cooled or allowed to cool to ambient temperature after drying 43A.

Figure 4B:
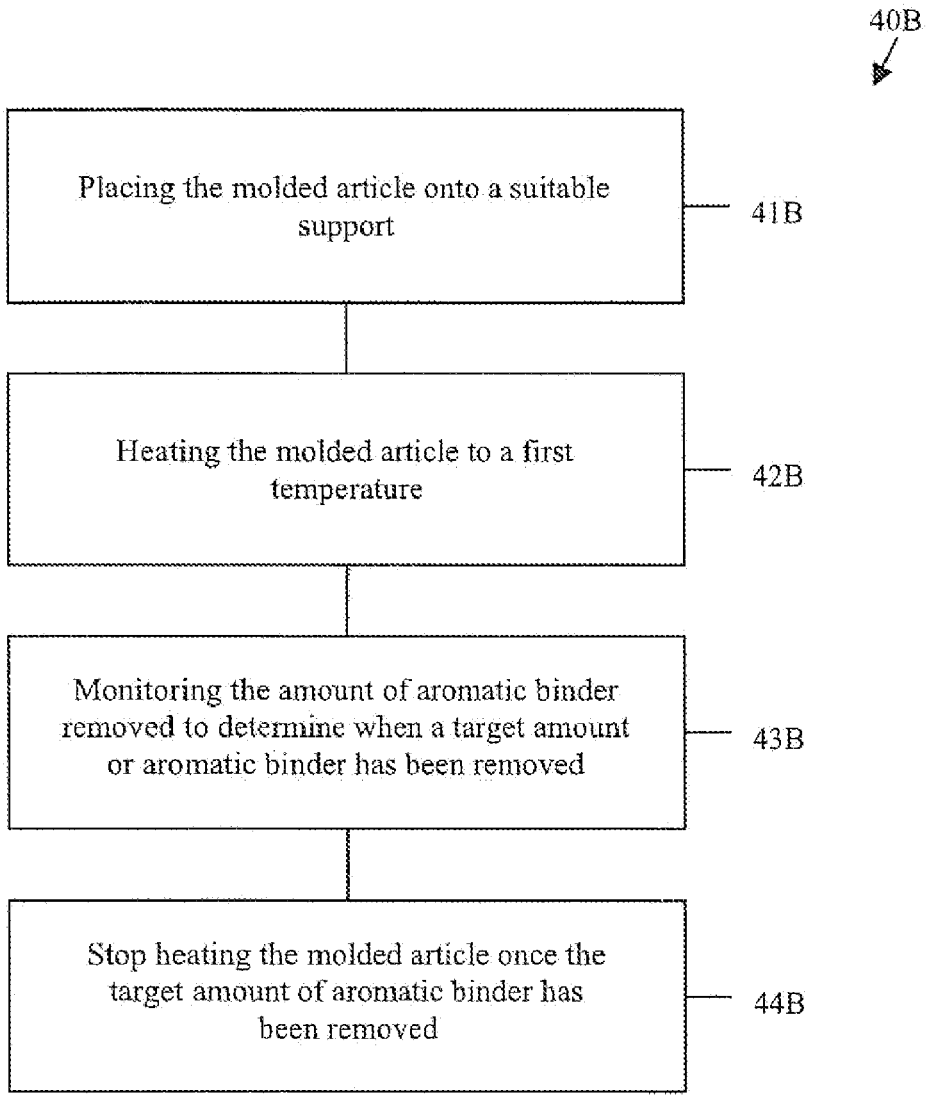
FIG. 4B schematically depicts another example of the metal injection molding method of FIG. 1 with an atmospheric pressure heating step for substantially removing the aromatic binder.

An alternative method for substantially removing the aromatic binder 40B is shown in FIG. 4B. Method 40B includes placing the molded article onto a suitable support 41B. A support is suitable if it inhibits pick-up of oxygen, carbon, or other impurities in the molded article during the aromatic binder removal process. Suitable supports include zirconia or yittria, or supports coated with zirconia or yittria. The molded article is heated, in an oven or the like, to a first temperature 42B. In some examples, the first temperature is between 100 and 140° F. The amount of aromatic binder removed is monitored 43B to determine when a target amount, such as 85%, of the aromatic binder has been removed. Once the target amount of aromatic binder has been removed, heating of the molded article to the first temperature is stopped 44B. In some examples, it can take between 24 and 240 hours to remove the target amount of aromatic binder, depending on the size of the molded article.

Figure 4C:
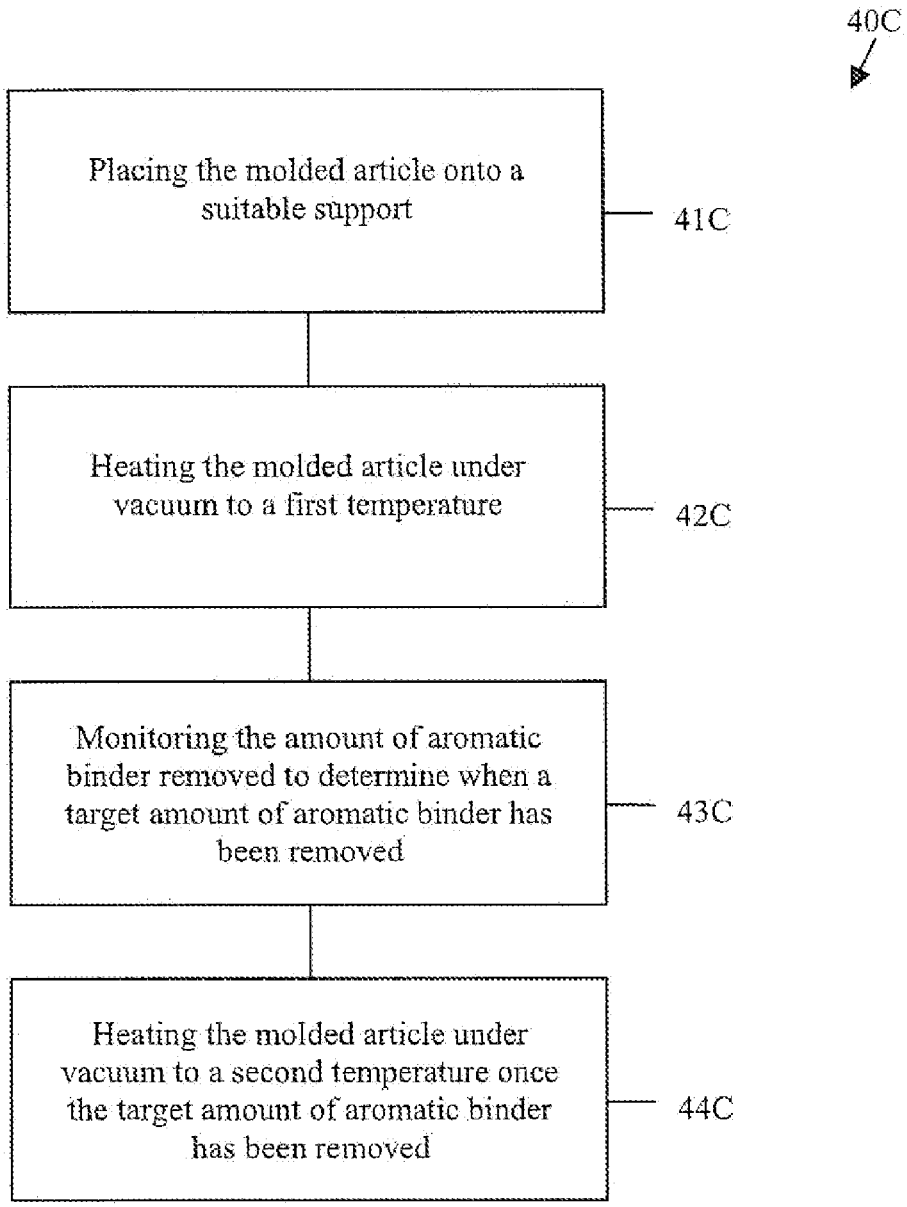
FIG. 4C schematically depicts another example of the metal injection molding method of FIG. 1 with a heated vacuum step for substantially removing the aromatic binder.

An alternative method for substantially removing the aromatic binder 40C is shown in FIG. 4C. Similarly to method 40B, method 40C includes placing the molded article onto a suitable support 41C, such as supports made of zirconia or yittria, or supports coated with zirconia or yittria. The molded article is heated under vacuum to a first temperature 42C. In some examples, the first temperature is between 80 and 120° F. The amount of aromatic binder removed is monitored 43C to determine when a target amount, such as 85%, of the aromatic binder has been removed. Once the target amount of aromatic binder has been removed, the molded article is heated to a second temperature 44C, such as 300° F., to substantially remove the remaining aromatic binder. Other components, such as the lubricant, may also be removed. In some examples, it can take between 24 and 72 hours to substantially remove the aromatic binder, depending on the size of the molded article.

An example of a method for sintering the molded article to into a metal article 50 is provided in FIG. 5. Sintering is performed to consolidate the molded article into a dense metal article. In the sintering method example 50 shown in FIG. 5, the molded article is placed on a suitable support 51, such as supports made of zirconia or yittria, or supports coated with zirconia or yittria. The supported molded article is then typically placed into a vacuum furnace. The pressure of the vacuum furnace may be reduced 52, such as to below 50 microns.

The temperature of the vacuum furnace is typically ramped up to a peak temperature 53, such as a peak temperature of 2,450° F. However, different peak temperatures may be selected. Further, different temperature ramping rates may be selected to effectuate removal of the thermoplastic from the molded article. In general, a slower ramp rate allows more time for the thermoplastic to be removed. Ramp rates of 1 to 20 hours have been effectively used, depending on the size of the article and the amount of thermoplastic to be removed. The molded article is typically held at the peak temperature for a hold time 54, such as a hold time of 1 hour, and then cooled to a cool down temperature 55, such as 200° F. The hold time is selected to allow for sufficient densification via sintering. In some examples, metal articles having densities of 97% are achieved through sintering. Introducing argon or helium gas in conjunction with a fan and heat exchanger can bring about rapid cooling.

Figure 7:
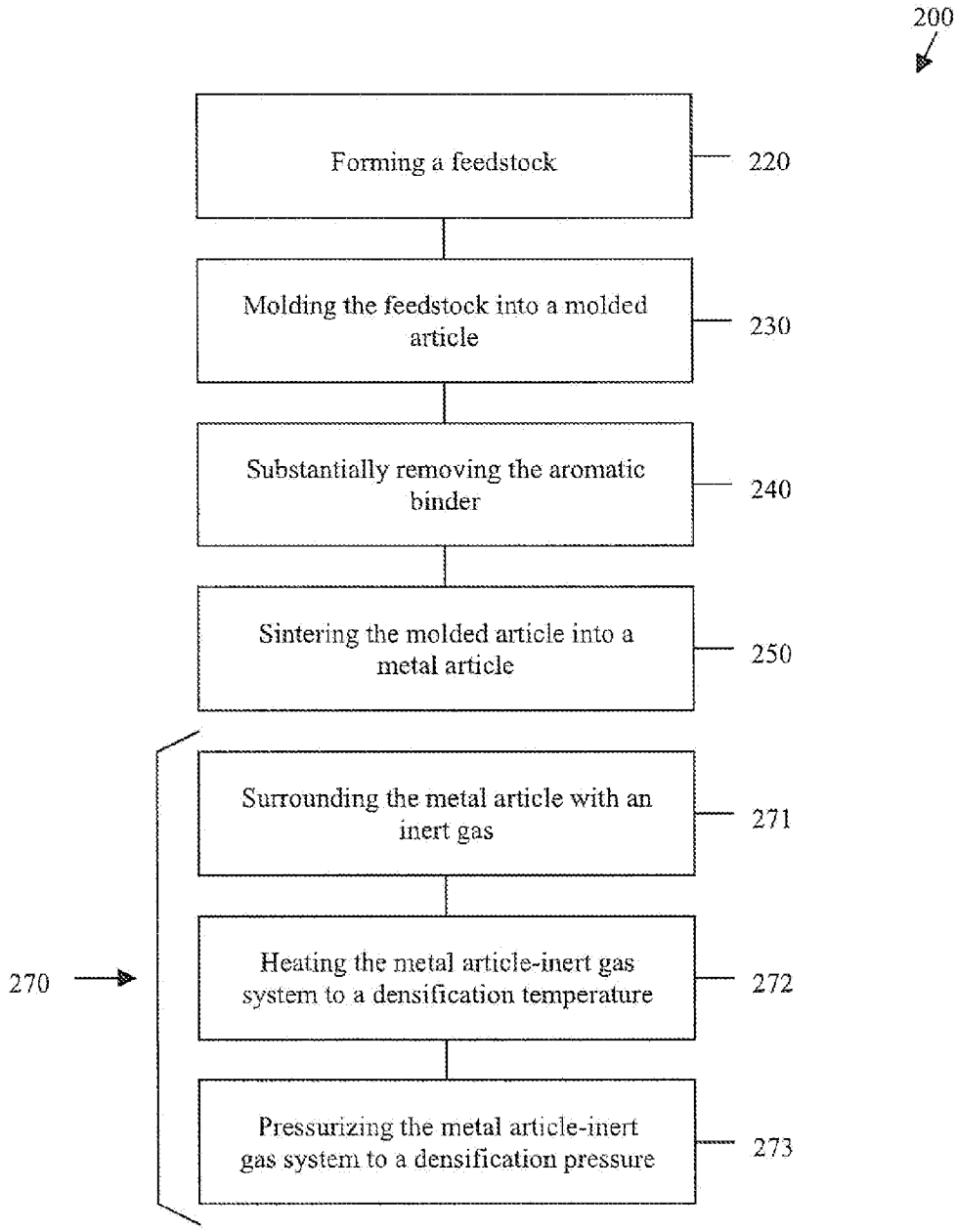
FIG. 7 schematically depicts an example of a metal injection molding and densification method according to the present disclosure.

The article removed from the vacuum oven and resulting from sintering method 50 is a metal article in a final form. Metal articles formed via the metal injection molding methods 10 described herein, typically meet aerospace and medical grade specifications for all alloying constituents. One example of a specification that metal articles produced via method 10 routinely meet is ASTM F 1474 for Ti 6Al 4V alloy. Another example is for Ti 6Al 4V/10% TiC matrix composite, as well as standard grade 2, 3, 4, and 5 titanium. Oxygen concentrations in the final metal article are typically less than 2000 ppm, carbon concentrations are routinely less than 800 ppm, and nitrogen concentrations are most often below 500 ppm. Additional and/or alternative methods are shown in FIGS. 6 and 7 for producing metal articles with reduced oxygen levels and increased densities.

An example of a metal injection molding and oxygen reduction method 100 is shown in FIG. 6. Method 100 is similar in many respects to method 10, with a further included oxygen reduction method 160. Accordingly, similar method steps are given similar 100 level numbers, e.g. 20 v. 120. As shown in FIG. 6, metal injection molding and oxygen reduction method 100 may include forming a feedstock 120; molding the feedstock into a molded article 130; substantially removing the aromatic binder 140; sintering the molded article into a metal article 150; and reducing the oxygen level of the metal article 160. For the sake of brevity, the discussion relating to steps 20, 30, 40, and 50 above will be relied upon for the description of steps 120, 130, 140, and 150. Reducing the oxygen level in the metal article 160 is described more fully below. Reducing the oxygen level in the metal article 160 is most often employed when the metal article is a reactive metal.

With reference to FIG. 6, reducing the oxygen level 160 typically starts by enclosing the metal article in a container with a deoxidizing agent 161. Suitable deoxidizing agents include certain alkali and alkaline earth metals. Sodium, magnesium, and calcium metals have proved effective as deoxidizing agents. Preferably, calcium metal is used as the deoxidizing agent. In some examples, deoxidizing agent in an amount equal to 1-10% of the metal article weight is used.

As shown in FIG. 6, the air inside the container may be replaced with an inert gas to a selected pressure 162. Purified argon gas is suitable for the inert gas and positive pressures of 5 psi have proved effective.

With further reference to FIG. 6, the container may be heated 163 and held at an elevated temperature for a period of time. The elevated temperature is typically selected to be higher than the melting point of the deoxidizing agent, which in the case of calcium metal is 1542° F. For example, the container may be heated to a temperature of between 1600 and 1800° F. while under 5 psi of pressure. Higher temperatures could also be used. However, at higher temperatures, consideration must be given to the chance that titanium might form a eutectic with the container and result in a melt through, such as when the container is made from stainless steel. The container is typically held at approximately 1800° F. and 5 psi for between 2 and 24 hours, then cooled to ambient temperature 164. The metal article may then be washed in an acid solution 165 to remove any residual calcium and calcium oxide that may be present on the surface of the metal article.

Metal articles produced via metal injection molding and oxygen reduction methods 100 routinely meet extra low interstitial ASTM F 136 standards for eli grade Ti 6Al 4V. Oxygen reduction also facilitates enhanced ductility of the metal article, which can be an important property in the medical and aerospace industries.

An example of a metal injection molding and densification method 200 is shown in FIG. 7. Method 200 is similar in many respects to method 10, with a further included densification method 270. Accordingly, similar method steps are given similar 200 level numbers, e.g. 20 v. 220. As shown in FIG. 7, metal injection molding and densification method 200 may include forming a feedstock 220; molding the feedstock into a molded article 230; substantially removing the aromatic binder 240; sintering the molded article into a metal article 250; and increasing the density of the metal article 270. For the sake of brevity, the discussion relating to steps 20, 30, 40, and 50 above will be relied upon for the description of steps 220, 230, 240, and 250. Increasing the density of the metal article 270 is described more fully below.

With reference to FIG. 7, densification method 270 typically includes surrounding the metal article with an inert gas 271, such as purified argon. Surrounding the metal article with an inert gas 271 can be thought of as creating a metal article-inert gas system. Densification method 270 may proceed by heating the metal article-inert gas system to a densification temperature 272. The densification temperature may range from between 1,600 and 2,225° F. In examples where the metal power includes cobalt chrome, a densification temperature range of between 1,600 and 2,225° F. is suitable. In examples where the metal powder includes titanium, a densification temperature range of between 1,600 and 1,750° F. is preferred.

The densification method 270 shown in FIG. 7 includes pressuring the metal article-inert gas system to a densification pressure 273. A range of densification pressures are suitable, and at least 15,000 psi has been found to be effective. Preferably, a densification pressure range of between 15,000 and 45,000 psi is used. More preferably, a densification pressure range of between 15,000 and 25,000 psi is employed. In examples where the metal powder includes titanium, a densification pressure range of between 15,000 and 20,000 psi is typically selected. After heating 272 and pressurizing 273 the metal article, densities approaching 100% are routinely obtained.

Specific examples of the metal injection molding methods and feedstocks of the present disclosure are described to provide a fuller understanding. The methods and feedstocks according to the present disclosure are certainly not limited to the following specific examples described. Rather, the following specific examples merely demonstrate the many and various features the methods and feedstocks may include.

TABLE 1

Feedstock Compositions

| Feedstock | Weight (g) | | | | |
|---|---|---|---|---|---|
| Component | Example 1 | Example 2 | Example 3 | Example 4 | Example 6 |
| Naphthalene | 183.69 | 167.09 | 152.4 | 158.9 | 15 |
| Polystyrene | 52.48 | 45.4 | 43.69 | 45.4 | 3 |
| Stearic acid | 26.54 | 22.7 | 21.8 | 22.7 | 2 |
| Metal powder | 2000 - stainless steel (400 mesh 17-4 ph) | 2000 - Co/Cr/Mo (16 micron) | 1058.85 - Ti 6Al 4V (44 micron) 86.01 - TiC (5 micron) | 1153 - Ti 6Al 4V (44 micron, spherical) | 80 - $TiH_2$ (200 mesh) |

EXAMPLE 1

Example 1 demonstrates one embodiment of a metal injection molding method for forming a stainless steel metal article. The amounts of each feedstock component used are provided in Table 1 above.

The naphthalene was added to a mixer and heated to 200° F. The polystyrene was added and stirred until dissolved. The stearic acid was added and melted. The stainless steel powder was added and blended until a consistent liquid was formed. After approximately 20 minutes, the liquid mixture was poured into an aluminum foil lined pan and allowed to cool to approximately room temperature. The hardened slab was broken up and placed into a grinder, which pulverized the mixture into a coarse powder. The resulting coarse powder was used as a feedstock to make the stainless steel metal article.

The feedstock was added to the hopper of an Arburg plastic injection machine and injection molded into a steel cavity test bar die. The injection pressure was set at 500 psi and the nozzle temperature was set at 190° F. The resulting injected test bars weighed 11.8 g each.

The test bars were placed on Zirconia coated graphite plates and placed in a vacuum oven. The oven was evacuated to below 100 microns pressure and heated to 90° F. and held for 20 hours. The temperature was raised to 140° F. over a period of 12 hours and held for another 20 hours. The oven was then heated to 200° F. over a period of 12 hours and held for another 20 hours, at which time the heat was turned off and the parts were cooled to room temperature under vacuum. The debinded parts weighed approximately 1 g less than before the vacuum debinding cycle. The debinded test bars were placed into a high temperature vacuum furnace, heated over a controlled cycle to 2,250° F., and held for 2 hours at that temperature. After cooling, the bars were mechanically tested. The testing results are shown in Table 2 below.

TABLE 2

Mechanical Testing Results

| Test Parameter | Example 1 | Example 2 | Example 3 | Example 4 |
|---|---|---|---|---|
| Tensile Strength (ksi) | 170 | 135 | 148.6 | 137.1 to 140.3 |
| Yield Strength (ksi) | 158 | 70 | 138.5 | 123.7 to 126.2 |

TABLE 2-continued

| Mechanical Testing Results | | | | |
|---|---|---|---|---|
| Test Parameter | Example 1 | Example 2 | Example 3 | Example 4 |
| Elongation (%) | Not Tested | 22 | 4 | 9 to 11.5 |
| Area Reduction (%) | Not Tested | Not Tested | 7.6 | 21.5 to 22 |

EXAMPLE 2

Example 2 demonstrates one embodiment of a metal injection molding method for forming a Co/Cr/Mo metal article. The amounts of each feedstock component used are provided in Table 1 above.

The naphthalene was melted at 200° F. in a 1 gal. mixer. The stearic acid was added to the mixer and melted into the 200° F. naphthalene. The polystyrene was subsequently added to the mixer. The mixture was stirred until the polystyrene dissolved. The Co/Cr/Mo powder was slowly added to the mixer while continuing to stir the mixture. The mixture was stirred for approximately 30 minutes, after which it was discharged onto a pan lined and covered in aluminum foil. The mixture was then cooled on the pan to room temperature. The slab was broken into chunks, and the chunks were fed into a grinder and ground into a coarse powder feedstock.

The feedstock was added to the hopper of an Arburg plastic injection machine. The temperature of the barrel nozzle was set at 190° F., and the injection pressure was set at 500 psi. The feedstock was injected into a test bar die and several test bar shapes were made weighing 12.56 g each.

The binder was removed from the test bars by placing them into a vacuum oven. The pressure of the vacuum oven was reduced to below 100 microns and the vacuum oven was held at 90° F. for 20 hours. Subsequently, the temperature was raised to 140° F. over a period of 12 hours and held for another 20 hours. The oven was then heated to 200° F. over a period of 12 hours and held for another 20 hours, at which time the heat was turned off and the parts were cooled to room temperature under vacuum. After removing the binder, the test bars had a weight loss of approximately 0.9 g each.

To sinter the test bars, they were loaded into a vacuum sintering furnace and heated to 2,250° F. at a partial pressure of 200 microns of Argon gas for approximately 1 hour. The furnace was subsequently gas fan cooled to below 200° F.

After being sintered, the test bars were removed and sent out for HIP (hot isostatic pressing) at 25,000 psi and 2,165° F. for 4 hours. Following the HIP process, the test bars were solution annealed at 2,175° F. in a vacuum furnace for 4 hours. The test bars were then gas fan cooled and sent out for testing. Chemistry tests showed that the bars conformed to ASTM F-75 chemistry. Mechanical testing results are shown in Table 2 above.

EXAMPLE 3

Example 3 demonstrates one embodiment of a metal injection molding method for forming a titanium matrix composite metal article. The amounts of each feedstock component used are provided in Table 1 above.

The naphthalene and stearic acid were melted together in a heated container at 200° F. The polystyrene was added to the mixture and stirred until dissolved. The TiC powder was dry blended with the Ti 6Al 4V powder and slowly added to the liquid naphthalene mixture. The resulting liquid feedstock mixture was poured onto an aluminum foil lined pan, covered, and cooled to room temperature. The cooled slab was broken into smaller pieces, processed through a lab granulator, and ground into a coarse powder, which was stored in a sealed container.

The granulated feedstock was subsequently loaded into an Arburg plastic injection machine. The temperature of the barrel nozzle was set at 190° F., and the injection pressure was set at 500 psi. Several injections were performed to produce test bars weighing 7.6 g each.

To remove binder from the test bars, they were immersed in a circulating alcohol bath at room temperature for 12 hours. The test bars were then removed from the alcohol bath, placed in a drying oven at 150° F. for 1 hour, and weighed. The average weight of the bars was 6.9 g.

To sinter the dried bars, they were placed on zirconia board and loaded into a vacuum sintering furnace. The furnace was evacuated to below 5 microns of pressure and slowly heated to a peak temperature of 2,450° F. Upon reaching the peak temperature, the furnace was held at that temperature for one hour. The bars were then furnace cooled to below 200° F. and removed.

Subsequently, the sintered bars were subjected to HIP processing. The HIP processing involved heating the bars to 1,650° F. in argon gas and pressurizing them to 15,000 psi. The bars were then allowed to cool and sent out for mechanical and chemical testing. The mechanical properties are provided in Table 2 above. The chemical composition of the test bars is provided in Table 3 below.

TABLE 3

| Chemical Composition Results | | | |
|---|---|---|---|
| Chemical | Composition (%) | | |
| Element | Example 3 | Example 4 | Example 6 |
| N | .03 | Not tested | Not tested |
| C | 1.44 | 0.0497 | 0.0316 |
| H | .001 | Not tested | Not tested |
| Fe | .07 | Not tested | Not tested |
| O | .18 | 0.197 | 0.38 |
| Al | 5.6 | Not tested | Not tested |
| V | 3.6 | Not tested | Not tested |
| Ti | Balance | Not tested | Not tested |

EXAMPLE 4

Example 4 demonstrates one embodiment of a metal injection molding method for forming a titanium alloy metal article. The amounts of each feedstock component used are provided in Table 1 above.

All the feedstock ingredients were placed in a covered and heated sigma blade mixer with an auger extruder discharge. The temperature of the mixer was set at 200° F. The blade speed was set at approximately 40 rpm, and the ingredients were mixed until the batch liquefied. Upon liquefying, the ingredients were mixed another half hour to ensure consistency. The heat was then turned off while continuing to mix the feedstock as it cooled. The feedstock granulated into a coarse powder as it solidified during cooling. The granulated feedstock was then discharged into a plastic container.

The granulated feedstock was loaded into an Arburg plastic injection machine with a nozzle temperature setting of 190° F. and an injection pressure setting of 500 psi. The feedstock was injected into a die cavity to form test bars weighing 8.56 g each. The binder was removed from the test bars in a vacuum oven heated to between 100° F. and 300° F. over a period of 72 hours.

To sinter the test bars, they were loaded into a vacuum sinter furnace and further processed on the following heat cycle under less than 5 microns vacuum: 1) heating the furnace from 75° F. to 625° F. over 30 minutes; 2) maintaining the furnace at 625° F. for 30 minutes; 3) ramping the heat to 750° F. over 30 minutes; 4) maintaining the furnace at 750° F. for 30 minutes; 5) ramping the furnace temperature to 900° F. over 1 hour; 6) maintaining the furnace at 900° F. for 1 hour; 7) ramping the furnace temperature to 2450° F. over 5 hours; 8) maintaining the furnace temperature at 2450° F. for 1 hour; and 9) turning off the furnace heat and allowing it to cool.

Following sintering, the test bars were subjected to HIP processing. The HIP processing involved heating the bars to 1650° F. and pressurizing them to 15,000 psi for 2 hours. Chemical testing data and mechanical testing data of the resulting test bars are shown above in Tables 2 and 3, respectively.

EXAMPLE 5

Example 5 demonstrates one embodiment of an oxygen reduction method according to the present disclosure for use in conjunction with metal injection molding methods.

A stainless steel retort with a sealable lid was used to remove oxygen from metal injection molding parts weighing approximately 2.5 g each. Four cervical disc shaped parts made from the same Ti 6Al 4V metal injection molding feedstock were coded by scribing them with the letters A,B,C, and R. The code C part was not processed, but instead was used as a control to compare its oxygen content to the other parts. The other three parts were suspended in a retort with a 1:1 ratio of calcium metal shot. The retort was evacuated and backfilled three times before applying heat. Subsequently, the retort was pressurized to 5 psi and heated to 1770° F. while maintaining an argon gas pressure of 2 to 5 psi. The temperature of the retort was held at 1770° F. for 5 hours, and then the heat was turned off and the retort allowed to cool while maintaining a positive gas pressure of 2 to 5 psi. After cooling, the parts were removed and soaked in a 5% HCI solution for 4 hours to remove deposits from the surface of the parts. The parts were then rinsed in deionized water, air dried, and tested for bulk oxygen analysis. The bulk oxygen analysis results are shown in Table 4 below.

TABLE 4

Bulk Oxygen Concentration

| Sample Part | Bulk Oxygen Concentration (%) |
|---|---|
| Code C (control) | 0.221 |
| Code A | 0.121 |
| Code B | 0.123 |
| Code R | 0.101 |
| Parts heated to 1770° F. for 10 hours | 0.077-0.079 |

Additional sample parts were processed at 1770 F for 10 hours in the retort with equal weight of Calcium metal. Oxygen level testing for these parts heated for 10 hours is shown in Table 4 above. It was determined that 5 to 10 hours of heating with calcium metal is sufficient to reduce oxygen up to 50% in Ti 6Al 4V metal injection molding parts.

EXAMPLE 6

Example 6 demonstrates one embodiment of a metal injection molding method for forming a titanium hydride metal article. The amounts of each feedstock component used are provided in Table 1 above.

In a heated, covered container, naphthalene was melted at approximately 200° F. Polystyrene was added and dissolved while hand stirring. Stearic acid was then blended into the mixture. Subsequently, $TiH_2$ powder was added while continuing to stir. The mixture was poured onto aluminum foil, covered, and allowed to cool. Pieces of the cooled slab were broken off and held at 100° F. in air over a two week time period. When the $TiH_2$ pieces reached a constant weight, they were loaded into a sintering furnace. The temperature of the sintering furnace was brought up to 2,300° F. and held for 1 hour. The $TiH_2$ pieces were then cooled and tested for oxygen and carbon levels. The chemical testing results are shown in Table 3 above. The chemical properties of the $TiH_2$ pieces indicates that the feedstock was capable of meeting ASTM grade 4 properties. Subsequently batches of a similar formula were made and injection molded.

It is believed that the disclosure set forth above encompasses multiple distinct inventions with independent utility. While each of these inventions has been disclosed in a particular form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Where the disclosure or subsequently filed claims recite "a" or "a first" element or the equivalent thereof, it is within the scope of the present inventions that such disclosure or claims may be understood to include incorporation of one or more such elements, neither requiring nor excluding two or more such elements.

Applicant reserves the right to submit claims directed to certain combinations and subcombinations that are directed to one of the disclosed inventions and are believed to be novel and non-obvious. Inventions embodied in other combinations and subcombinations of features, functions, elements and/or properties may be claimed through amendment of those claims or presentation of new claims in that or a related application. Such amended or new claims, whether they are directed to a different invention or directed to the same invention, whether different, broader, narrower or equal in scope to the original claims, are also regarded as included within the subject matter of the inventions of the present disclosure.

What is claimed is:

1. A method for forming a metal article comprising:

forming a feedstock by mixing together a lubricant, an aromatic binder, a thermoplastic, and a metal powder;

molding the feedstock into a molded article by maintaining the feedstock at a temperature between 150 and 200° F., pressurizing the feedstock to a pressure of not more than 1000 psi to inject the feedstock into a mold, and maintaining the mold at a temperature not more than 120° F.;

substantially removing the aromatic binder from the molded article; and sintering the molded article to form the metal article by heating the molded article.

2. The method of claim 1, wherein:

the feedstock is pressurized to between 400 and 500 psi to inject the feedstock into a mold, and the mold is maintained at a temperature between 50 and 90° F.

3. The method of claim 1, wherein forming a feedstock comprises mixing together 3-6 vol. % of the lubricant, 8-12 vol. % of the thermoplastic, 28-38 vol. % of the aromatic binder, and 44-69 vol. % of the metal powder.

4. The method of claim 3, wherein:

the lubricant is stearic acid;

the aromatic binder is naphthalene;

the thermoplastic is polystyrene; and the metal powder is titanium, a titanium alloy, titanium hydride, a titanium matrix composite, or combinations thereof.

5. The method of claim 4, wherein:

substantially removing the aromatic binder from the molded article includes immersing the molded article into an ethanol bath at ambient temperature; and sintering the molded article to form the metal article includes heating the molded article to at least 2450° F.

6. The method of claim 1, wherein the lubricant includes stearic acid.

7. The method of claim 1, wherein the aromatic binder includes naphthalene.

8. The method of claim 1, wherein the thermoplastic includes polystyrene.

9. The method of claim 1, wherein the metal powder includes titanium, a titanium alloy, titanium hydride, or a titanium matrix composite, or combinations thereof.

10. The method of claim 1, wherein:

the lubricant includes stearic acid;

the aromatic binder includes naphthalene;

the thermoplastic includes polystyrene; and the metal powder includes titanium, a titanium alloy, titanium hydride, or a titanium matrix composite, or combinations thereof.

11. The method of claim 1, wherein removing the aromatic binder from the molded article includes immersing the molded article into an alcohol bath.

12. The method of claim 11, wherein the alcohol bath is ethanol.

13. The method of claim 11, wherein immersing the molded article into the alcohol bath occurs at ambient temperature.

14. The method of claim 1, wherein forming a feedstock includes mixing together not more than 10 vol. % of a lubricant, 6-15 vol. % of a thermoplastic, 20-40 vol. % of an aromatic binder, and 35-74 vol. % of a metal powder.

15. The method of claim 1, further comprising:

enclosing the molded article in a container with a deoxidizing agent in an inert gas environment substantially free of air; and heating the container containing the molded article and the deoxidizing agent to between 1600 and 1800° F.

16. The method of claim 15, wherein the molded article is enclosed with an amount of the deoxidizing agent equal to 1-10% of the weight of the molded article.

17. The method of claim 15, wherein the deoxidizing agent includes calcium metal.

18. The method of claim 15, wherein forming a feedstock includes mixing together not more than 10 vol. % of a lubricant, 6-15 vol. % of a thermoplastic, 20-40 vol. % of an aromatic binder, and 35-74 vol. % of a metal powder.

19. The method of claim 1, further comprising granulating the feedstock.

20. The method of claim 1, wherein the thermoplastic includes one or more of ethylene vinyl acetate, polyethylene, and butadiene.

21. The method of claim 1, wherein the metal powder includes copper, stainless steel, titanium, tantalum, or cobalt or combinations thereof.

22. The method of claim 1, wherein forming a feedstock includes mixing together a lubricant, an aromatic binder, a thermoplastic, and a metal powder until the viscosity of the resulting mixture becomes substantially constant.

* * * * *